US007125061B1

(12) United States Patent
Hajianpour

(10) Patent No.: US 7,125,061 B1
(45) Date of Patent: Oct. 24, 2006

(54) HANDLE DEVICE FOR CARRYING SHOPPING BAGS

(75) Inventor: Zoya Hajianpour, Fort Lauderdale, FL (US)

(73) Assignee: Zoya, Inc., Sunrise, FL (US)

( * ) Notice: Subject to any disclaimer, the term of this patent is extended or adjusted under 35 U.S.C. 154(b) by 15 days.

(21) Appl. No.: 10/927,841

(22) Filed: Aug. 27, 2004

(51) Int. Cl.
*A45F 5/10* (2006.01)

(52) U.S. Cl. ..... 294/159; 294/169

(58) Field of Classification Search ..... 294/137, 294/158, 159, 170, 171, 167, 169; 16/425; D9/434, 455
See application file for complete search history.

(56) References Cited

U.S. PATENT DOCUMENTS

| | | | | |
|---|---|---|---|---|
| 2,676,836 | A * | 4/1954 | Raphael | 294/87.24 |
| D269,253 | S * | 6/1983 | Gagnon | D9/434 |
| 4,657,295 | A * | 4/1987 | Holem | 294/162 |
| 4,846,519 | A | 7/1989 | Leonard | |
| D314,150 | S | 1/1991 | Preciutti | |
| 5,487,582 | A | 1/1996 | Bourgeois et al. | |
| 5,507,542 | A | 4/1996 | Eden | |
| 5,615,921 | A | 4/1997 | Marley et al. | |
| D388,326 | S | 12/1997 | Gurry et al. | |
| 5,709,425 | A * | 1/1998 | Cordova | 294/162 |
| 5,836,634 | A * | 11/1998 | Finkelman | 294/159 |
| 5,881,432 | A | 3/1999 | Good | |
| 6,247,739 | B1 * | 6/2001 | Lyon | 294/159 |
| D458,130 | S | 6/2002 | Ronne et al. | |
| D469,015 | S | 1/2003 | Le Roux | |
| 6,824,182 | B1 * | 11/2004 | Graham | 294/137 |

FOREIGN PATENT DOCUMENTS

| | | | |
|---|---|---|---|
| FR | 2541099 | * | 8/1984 |

* cited by examiner

*Primary Examiner*—Dean J. Kramer
(74) *Attorney, Agent, or Firm*—Ronald V. Davidge

(57) ABSTRACT

A handle device for carrying shopping bags includes a frame, a bag handle carrying member extending outward from each side of the frame, and a handle extending in a direction perpendicular to the hag handle carrying member. Preferably, the bag handle carrying member is pivotally mounted so that it can be brought into alignment with the handle and frame, with the device additionally including a retaining member movable into a position holding bag handles on the carrying member.

11 Claims, 3 Drawing Sheets

HANDLE DEVICE FOR CARRYING SHOPPING BAGS

BACKGROUND OF THE INVENTION

1. Field of the Invention

This invention relates to a handle device for carrying shopping bags and, more particularly, to a handle device for carrying two or more shopping bags, each having handle loops or apertures centrally located along the upper edge of elongated sides.

2. Summary of the Background Art

Traditionally, shopping bags have been given to customers by retail stores to carry items purchased within the stores, or have been sold or otherwise provided for use by customers within shopping malls. Additionally, some customers bring their own shopping bags to fill with purchased items. Typically, a shopping bag is formed with a pair of sides, and with a pair of ends, substantially narrower than the sides, extending between a closed bottom and an open top, with loops or openings, centrally located along the upper edge of each of the sides, being provided so that the bag can be easily carried. However, a shopping trip may often result in the accumulation of several shopping bags, which are difficult to carry simultaneously. Thus, what is needed is a device providing a handle for conveniently carrying a number of such shopping bags.

A different type of bag has been developed for use in stores, such as grocery stores and discount stores, where shopping carts are generally used to carry items to be purchased within the store and to carry purchased items from the store to the parking lot. This type of bag, which is made from a very thin sheet of flexible plastic, typically has an open top, a closed bottom, a pair of sides, and a pair of ends, substantially narrower than the sides, and a loop extending upward from each of the ends. The loops are provided so that the bag can be held open within a frame at the checkout station to load purchased items into the bag. Usually, the loops are then tied together to seal the bag. The loops are not designed to be used as handles for carrying the bag, as a number of the bags are typically carried from the store within a shopping cart.

The patent literature includes a number of examples of devices providing handles for carrying one or more of these plastic bags by means of the loops provided at the ends of the bag. Since the loops are at the narrow ends of the bag, each of the devices includes a bag loop support bar extending parallel to the handle. When both of the loops of a bag are hooked over the support bar, the elongated sides of the bag extend parallel to the handle, so that the bag and handle together form a package that is ergonomically acceptable for carrying in the conventional way, by a person's side. Suitcases, briefcases, and other packages designed to be carried in this way all have handles centrally located to extend parallel to their elongated sides. Devices having support bars or hooks extending parallel to carrying handles, for the attachment of loops of bags over the support bars or hooks, are shown and described, for example, in U.S. Pat. Nos. 5,507,542 and 5,615,921, and in U.S. Design Pat. Nos. D458,130 and D469,015. What is needed is a device having a handle and a carrying member arranged so that it be placed to extend through the loops or handle openings of a shopping bag having such loops or handle openings extending along its elongated sides, with the handle and carrying member being arranged so that the handle extends parallel to the carrying member.

The patent literature also includes a number of examples of devices to be fastened over the portions of a shopping bag sides extending above a central apertures within the sides to provide a larger or more comfortable handle than that provided by the portions of the sides themselves. Such devices are described, for example, in U.S. Pat. Nos. 4,846,519, 5,881,432, and 5,487,582. However, such devices are not readily adaptable for carrying multiple shopping bags simultaneously, and are somewhat more difficult to use than a device having a carrying member that can merely be inserted through the openings in loops.

SUMMARY OF THE INVENTION

Accordingly, a first objective of the invention is to provide a device for carrying one or more shopping bags with an elongated bag handle carrying member extending perpendicular to the hand-gripable handle member of the device.

Another objective of the invention is to provide such a device having a frame extending parallel to the hand-gripable handle member, into which the elongated bag handle is pivoted to be carried within a package or purse.

Yet another objective of the invention is to provide a device for carrying one or more shopping bags with an elongated bag handle carrying member and a bag handle retaining member that can be moved into position to retain bag handles on the carrying member.

According to a first aspect of the invention, apparatus is provided for carrying shopping bags, with the apparatus including a frame, a hand-gripable handle member, and an elongated bag handle carrying member. The frame includes sides extending in a first direction between ends. The hand-gripable handle member, which is attached to the frame, extends in the first direction. The elongated bag handle extends outward from the sides of the frame, and is preferably pivotable into a position extending within the frame in the first direction.

The apparatus preferably additionally includes a bag handle retaining member movable relative to the elongated bag handle carrying member between an open position and a closed position. With the bag handle retaining member in the open position, bag handles can be removed from the bag handle carrying member. With the bat handle retaining member in the closed position, bag handles are held on the bag handle carrying member.

DETAILED DESCRIPTION OF THE INVENTION

Figure 1:
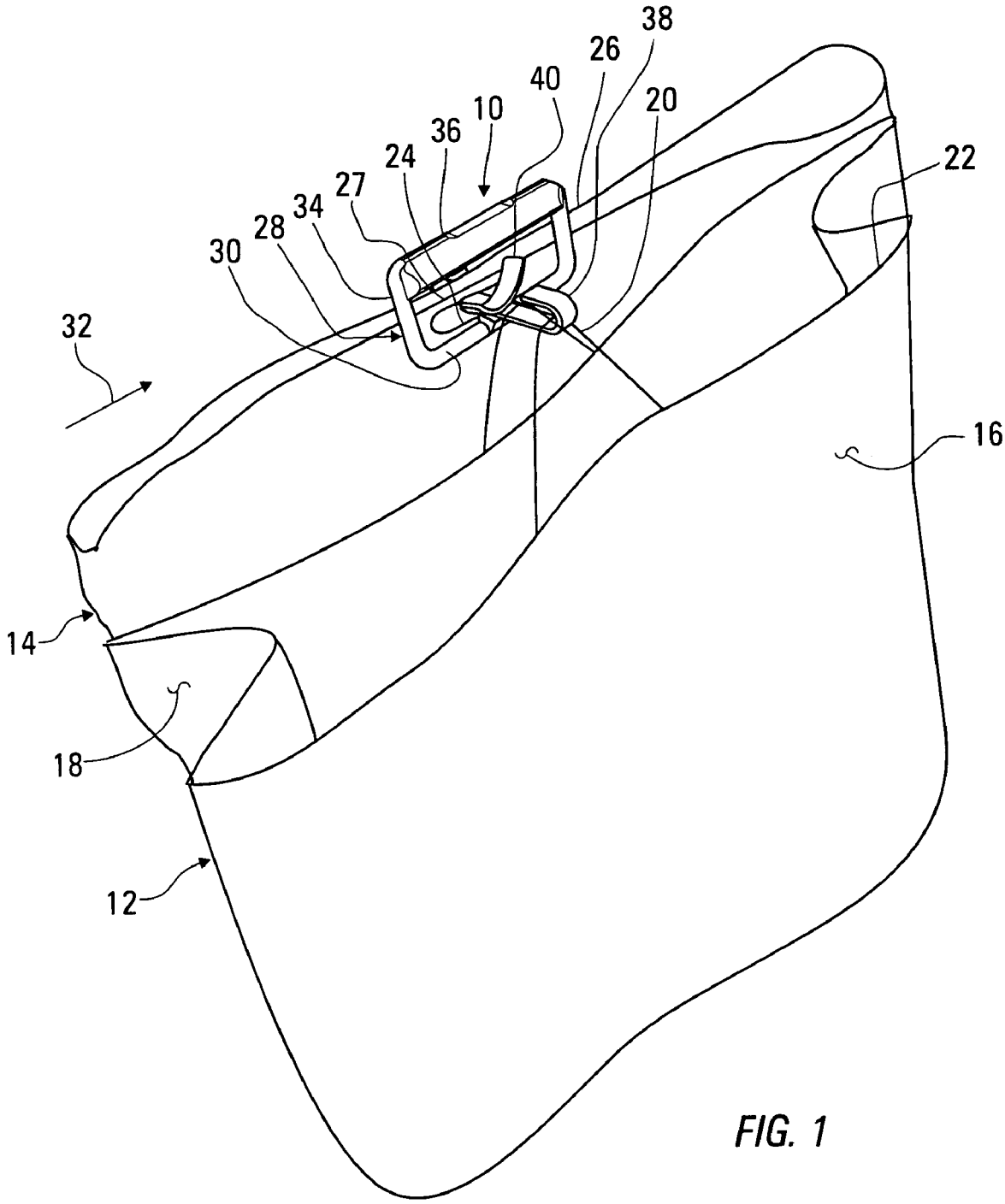
FIG. 1 is a perspective view of a handle device built in accordance with the invention, holding a pair of shopping bags.

FIG. 1 is a perspective view of a handle device 10 built in accordance with the invention holding a first shopping bag 12 and a second shopping bag 14. Each of the shopping bags 12, 14 has a pair of elongated sides 16 and a pair of ends 18, which are substantially narrower than the elongated sides 16. The first shopping bag 12 includes a pair of loops 20, extending upward from a central location at the upper edge 22 of its sides 16 to be used as handles. The second shopping bag 14 has a pair of openings 24 centrally located near the upper edge 26 of its sides 16, providing a pair of upper edge strips 27 to be used as handles.

The handle device 10 includes a frame 28, including sides 30 extending in a first direction, as indicated by arrow 32, between a pair of ends 34. The handle device 10 additionally includes a hand-gripable handle member 36, attached to the frame 28 to extend in the first direction of arrow 32, and an elongated bag handle carrying member 38, extending outward from each of the sides 30 of the frame 28. This orientation of the elongated bag handle carrying member relative to the hand-gripable handle member 36 allows the bags 12, 14 to be carried with their elongated sides extending parallel to the direction in which the handle member 36 extends, in the manner normal for a person carrying the bags 12, 14 by his side.

Preferably, the handle device 10 additionally includes a bag handle retaining member 40, which is shown in FIG. 1 in its open position, allowing the placement of bag handles, such as the loops 20 of the first shopping bag 12 or the upper edge strips 27 of the second shopping bag 14, on the bag handle carrying member 38, and further allowing the removal of such bag handles from the bag handle carrying member 38.

Figure 2:
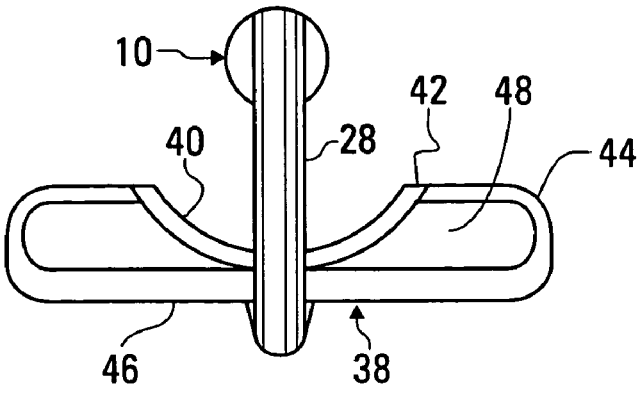
FIG. 2 is an end elevation of the handle device of FIG. 1, with a bag holding member therein in a deployed position.

FIG. 2 is an end elevation of the handle device 10, with the bag handle retaining member 40 being shown in a closed position, preventing the removal of bag handles from the bag handle carrying member 38. The bag handle retaining member 40 has an arcuate shape, with its ends 42 extending upward to close a gap with hook-shaped end portions 44 of the bag handle carrying member 38. The hook-shaped end portions of the carrying member 38 extend between a straight central portion 46 thereof. Bag handles within a closed space 48 at each side of the frame 28 between the retaining member 40 and the carrying member 38 are held within this space 46, so that a group of bags being carried by the handle device 10 can be set down without becoming disengaged from the handle device 10. The bag handle retaining member 40 is mounted to pivot relative to the bag handle carrying member 38, so that the bag handle retaining member 40 can be pivoted between the open position shown in FIG. 1 and the closed position of FIG. 2.

Figure 3:
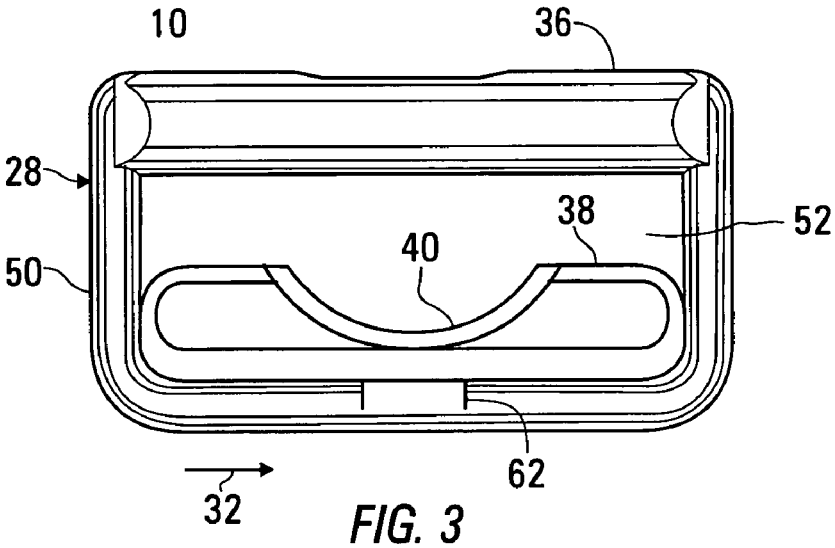
FIG. 3 is a side elevation of the handle device of FIG. 1, with the bag holding member in a stored position.

FIG. 3 is a side elevation of the handle device 10. The frame 28 includes a U-shaped portion 50 extending downward from the hand-gripable handle member 36. Preferably, the bag handle carrying member 38 is mounted to pivot about a central pivot, along with the bag handle retaining member 40, into a stored position in which these members 38, 40 extend in the direction of arrow 32 within an opening 52 between the handle member 36 and the U-shaped portion 50 of the frame 28.

Figure 4:
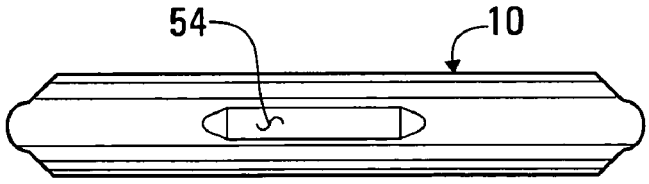
FIG. 4 is an end elevation of the handle device as shown in FIG. 3.
Figure 6:
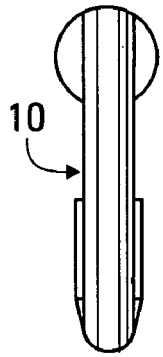
FIG. 6 is a bottom plan view of the handle device as shown in FIG. 3.
Figure 5:
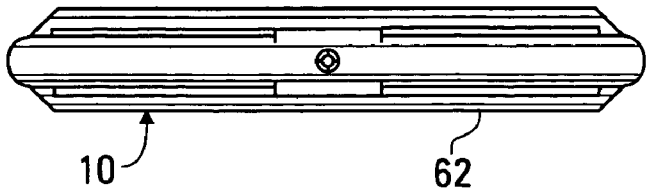
FIG. 5 is a plan view of the handle device as shown in FIG. 3.

FIGS. 4–6 are additional views of the handle device 10 with the bag handle carrying member 38 in its stored position and with the bag handle retaining member 40 in its closed position relative to the carrying member 38. FIG. 4 is an end elevation, FIG. 5 is a plan view, and FIG. 6 is a bottom plan view. The left and right views are identical, being represented by the end view of FIG. 4. The front and back elevations are also identical, being represented by the side view of FIG. 3. These views of FIGS. 4–6 show flattened shape obtained by rotating the hag handle carrying member 38 into its stored position with the bag handle retaining member 40 also in its closed position. This flattened shape makes it possible to easily carry the handle device 10 within a purse or pocket, with the bag handle carrying member 38 then being rotated into the deployed position shown in FIG. 2, and with the bag handle retaining member 40 being pivoted into its open position, before bag handles are placed on the carrying member 38. The handle device 10 may include an area 54 having a logo or advertising message.

Figure 7:
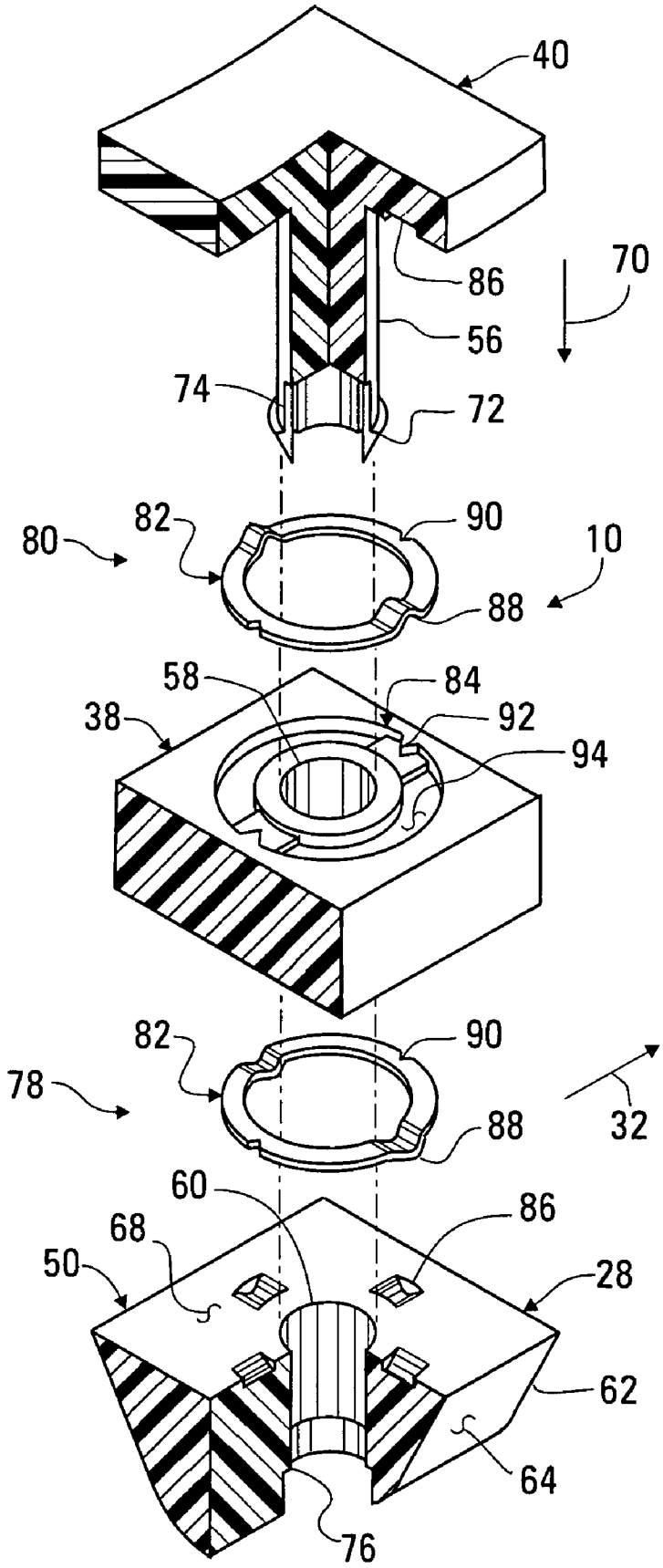
FIG. 7 is a fragmentary perspective view of the handle device of FIG. 1, showing the pivotal mounting of elements thereof in an exploded relationship with one another.

FIG. 7 is a fragmentary perspective view of the handle device 10, showing the pivotal mounting of the bag handle carrying member 38 and of the bag handle retaining member 40 on the frame 28. The bag handle retaining member 40 includes a central pivot shaft 56, which extends through a central pivot hole 58 within the bag handle carrying member 38 into a pivot shaft receiving hole 60 within the frame 28. Preferably, the U-shaped portion 50 of the frame 28 includes a central portion 62 having sides 64 that are outwardly inclined to provide a flat mounting surface 68.

The handle device 10 is assembled by pressing the bag handle retaining member 40 downward, in the direction of arrow 70, with the central pivot shaft 56 extending within holes 58, 60 until a latching step 72 on each of several cantilever tip portions 74 is moved below a step 76 within the shaft receiving hole 60. When this occurs, the cantilever tip portions 74 snap outward to retain the central pivot shaft 56 within the central pivot hole 60, while allowing the pivoting movement of the bag handle retaining member 40 and of the bag handle carrying member 38 relative to one another and relative to the frame 28.

Preferably, the handle device 10 additionally includes a bag handle carrying member detent mechanism 78 releasably holding the bag handle carrying member 38 in its deployed position, extending perpendicular to the direction of arrow 32, and in its stored position, extending in the direction of arrow 32. Preferably, the handle device 10 further includes a bag handle retaining member detent mechanism 80 releasably holding the bag handle retaining member 40 in its closed position, extending in the direction in which the bag handle carrying member 38 extends.

Each of the detent mechanisms 78, 80 includes a detent spring 82, an annular spring retaining slot 84 holding the detent spring 82 within the bag handle carrying member 38, and a number of notches 86 in the mating part. Each of the detent springs 82 has a pair of bumps 88 that move into corresponding notches 86 as the carrying member 38 or the retaining member 40 is brought into the position in which it is to be releasably held. Each of the detent springs 82 additionally has a pair of alignment notches 90 that hold the detent spring 82 in alignment with corresponding projections 92 in the annular spring retaining slot 94. The retaining slot 94 also includes a pair of recessed regions 94 into which the detent spring 82 deflects as the bumps 88 move out of the corresponding notches 86.

While the bag handle retaining member detent mechanism 80 includes an annular spring retaining slot 94 facing upward so that the corresponding detent spring 82 operates against a lower surface of the bag handle, the bag handle carrying member detent mechanism 78 includes an annular spring retaining slot (not shown) facing downward so that the corresponding detent spring 82 operates against the flat mounting surface 68 of the frame 28.

While the invention has been described in its preferred embodiment as having a pivotally mounted bag handle carrying member 38, it is understood that a version of the invention has a rigidly mounted bag handle carrying member that extends outward from each side of the frame. While the invention has been described in its preferred embodiment in some degree of particularity, it is understood that this description has been given only by way of example, and that many variations may be made without departing from the spirit and scope of the invention, as defined in the appended claims.

What is claimed is:

1. Apparatus for carrying shopping bags, wherein the apparatus comprises:

a frame including sides extending in a first direction between ends;

a hand-gripable handle member attached to the frame and extending in the first direction;

an elongated bag handle carrying member extending outward from each of the sides of the frame, and a bag handle retaining member movable relative to the elongated bag handle carrying member between an open position allowing removal of shopping bag handles from the elongated bag handle carrying member and a closed position blocking removal of shopping bag handles from the elongated bag handle carrying member by closing a gap adjacent a portion of the elongated bag handle carrying member extending outward from each of the sides of the frame, wherein the bag handle retaining member is mounted to pivot about a central pivot.

2. Apparatus for carrying shopping bags, wherein the apparatus comprises:

a frame including sides extending in a first direction between ends;

a hand-gripable handle member attached to the frame and extending in the first direction;

an elongated bag handle carrying member extending outward from each of the sides of the frame, and a bag handle retaining member movable relative to the elongated bag handle carrying member between an open position allowing removal of shopping bag handles from the elongated bag handle carrying member and a closed position blocking removal of shopping bag handles from the elongated bag handle carrying member, wherein the bag handle retaining member is mounted to pivot about a central pivot, wherein the bag handle carrying member includes a straight central portion and a hook-shaped curved portion at each end, and wherein the bag handle retaining member in the closed position extends between the hook-shaped curved portions to provide a closed space between the bag handle retaining member and the bag handle carrying member.

3. The apparatus of claim 2, additionally comprising a bag handle retaining member detent mechanism releasably holding the bag handle retaining member in the closed position.

4. The apparatus of claim 2, wherein the hook-shaped curved portions of the bag handle carrying member extend upward from the straight central portion, the bag handle retaining member includes an arcuate portion deployed adjacent the straight central portion of the bag handle carrying member at the central pivot and extending upward adjacent ends of the hook-shaped curved portions of the bag handle carrying member with the bag handle retaining member in the closed position.

5. Apparatus for carrying shopping bags, wherein the apparatus comprises:

a hand-gripable handle member extending in a first direction a frame attached to the handle member, including sides extending in the first direction between ends and a U-shaped portion extending downward from the handle member, and an elongated bag handle carrying member pivoted to move between a deployed position in which the elongated bag handle carrying member extends outward from each of the sides of the frame and a stored position, in which the elongated bag handle carrying member extends in the first direction, wherein the elongated bag handle carrying member is mounted to pivot about a central pivot within an opening extending between the U-shaped portion of the frame and the handle.

6. The apparatus of claim 5, additionally comprising a bag handle carrying member detent mechanism releasably holding the bag handle carrying member in the deployed position, extending perpendicular to the first direction, and in the stored position.

7. The apparatus of claim 5, additionally comprising a bag handle retaining member movable relative to the elongated bag handle carrying member between an open position allowing removal of shopping bag handles from the elongated bag handle carrying member and a closed position blocking removal of shopping bag handles from the elongated bag handle carrying member.

8. The apparatus of claim 7, wherein the bag handle retaining member is mounted to pivot about a central pivot.

9. The apparatus of claim 8, wherein the bag handle carrying member includes a straight central portion and a hook-shaped curved portion at each end, and the bag handle retaining member in the closed position extends between the hook-shaped curved portions to provide a closed space between the bag handle retaining member and the bag handle carrying member.

10. The apparatus of claim 9, additionally comprising a bag handle retaining member detent mechanism releasably holding the bag handle retaining member in the closed position.

11. The apparatus of claim 9, wherein the hook-shaped curved portions of the bag handle carrying member extend upward from the straight central portion, the bag handle retaining member includes an arcuate portion deployed adjacent the straight central portion of the bag handle carrying member at the central pivot and extending upward adjacent ends of the hook-shaped curved portions of the bag handle carrying member with the bag handle retaining member in its closed position.

* * * * *